US005679061A

United States Patent [19]

Thielenhaus

[11] Patent Number: 5,679,061

[45] **Date of Patent: *Oct. 21, 1997**

[54] SYSTEM FOR GRINDING RINGS WITH HYDRAULIC HOLDING

[75] Inventor: Ernst Thielenhaus, Wuppertal, Germany

[73] Assignee: Ernst Thielenhaus KG, Wuppertal, Germany

[ * ] Notice: The portion of the term of this patent subsequent to Oct. 18, 2011, has been disclaimed.

[21] Appl. No.: 778,738

[22] Filed: Oct. 18, 1991

[30] Foreign Application Priority Data

Oct. 24, 1990 [DE] Germany ..... 40 33 727.8

[51] Int. Cl.[6] ..... B42B 49/08

[52] U.S. Cl. ..... 451/51; 451/9; 451/25; 451/27; 451/269

[58] Field of Search ..... 451/51, 52, 9, 451/24, 25, 27, 163

[56] References Cited

U.S. PATENT DOCUMENTS

| | | | |
|---|---|---|---|
| 2,143,454 | 1/1939 | Schmidt | 451/27 |
| 2,688,219 | 9/1954 | Taylor | 451/25 |
| 2,777,257 | 1/1957 | Johnson | 451/25 |
| 2,777,321 | 1/1957 | Price . | |
| 4,519,170 | 5/1985 | Thielenhaus . | |
| 4,656,789 | 4/1987 | Schwar | 451/269 |
| 5,174,069 | 12/1992 | Thielenhaus | 451/9 |

FOREIGN PATENT DOCUMENTS

| | | | |
|---|---|---|---|
| 221 975 | 6/1962 | Australia . | |
| 1 805 307 | 10/1968 | Germany . | |
| 28 26 169 | 6/1978 | Germany . | |
| 31 09 962 | 3/1984 | Germany . | |
| 234 388 | 6/1985 | Germany . | |
| 403256669 | 11/1991 | Japan | 451/51 |
| 1 061 661 | 7/1965 | United Kingdom . | |

*Primary Examiner*—Robert A. Rose
*Assistant Examiner*—George Nguyen
*Attorney, Agent, or Firm*—Herbert Dubno; Andrew Wilford

[57] ABSTRACT

An annular workpiece having an inner peripheral surface and an outer peripheral surface at least one of which is centered on a workpiece axis is ground by supporting the workpiece hydraulically on a liquid layer in a support for rotation about the axis, rotating the workpiece about the axis, and engaging a grinding tool radially against the one surface and thereby removing material from the one surface. A plurality of measuring shoes are supported at angularly equispaced locations about the axis and are urged radially toward the one surface. A jet of liquid is projected from each of the shoes against the one surface such that the liquid forms a layer supporting the shoes on the one surface and merges with the liquid supporting the workpiece. The radial positions of the shoes are monitored relative to the axis and the removal of material from the one surface by the grinding tool is controlled, either by varying grinding force or stopping grinding altogether, in accordance with the monitored radial positions.

9 Claims, 3 Drawing Sheets

SYSTEM FOR GRINDING RINGS WITH HYDRAULIC HOLDING

FIELD OF THE INVENTION

The present invention relates to a system for grinding rings. More particularly this invention concerns a measuring method used to control the grinding of rings such as bearing races.

BACKGROUND OF THE INVENTION

It is known for example from my U.S. Pat. No. 4,519,170 to support a workpiece to be ground on a layer of a pressurized hydraulic medium. A ring workpiece whose inside periphery is to be ground is fitted with a tiny spacing of several microns in an annular chuck and the annular space around the ring is filled with hydraulic fluid to center the workpiece in the chuck. To grind the outside periphery the workpiece is fitted over a core chuck and the annular space between the outside of the chuck and the inside periphery of the workpiece is similarly pressurized to center the workpiece. In both arrangements a drive member normally axially engages the workpiece and rotates it about its axis to turn it relative to a tool that is angularly fixed but radially displaceable against the periphery to be machined, outward against the inner periphery or inward against the outer periphery. The advantage of such as system is that little stress is applied to the workpiece by the chuck so that it is not deformed, and also that the workpiece is very accurately centered.

Clearly such a procedure is only used for finish grinding, that is when working to extremely high tolerances. It is therefore of course necessary to monitor the grinding operation by taking periodic measurements of the surface being ground. Typically the radius of curvature of the surface being ground is continuously or intermittently measured and this measurement is compared in a control computer as an actual value against a set point representing the desired radius of curvature, and grinding is continued or stopped according to whether or not the desired size is attained.

These measurements are typically taken by means of feelers which mechanically touch the surface being machined with a tiny diamond point. Not only can such a procedure mar the surface, but it is also possible for the feeler to displace the workpiece in its hydraulic centering or even deform the workpiece slightly. In addition the workpiece inherently has microscopically eccentric regions that create vibrations in the measuring device that in turn give false readings.

In other machining operations contactless measurements are proposed. For instance a compressed-air jet is directed from a nozzle at a surface being machined to create a restriction between the nozzle tip and the workpiece. The nozzle tip is held stationary so that the flow cross section of the restriction changes proportionately with the spacing between the nozzle tip and the workpiece surface, so that the pressure in the nozzle can be measured to determine workpiece spacing. Such a procedure is not normally extremely sensitive so it is unusable in, for instance, machining of bearing races.

It is also known when machining a flat surface to use a nozzle as described above, but emitting a continuous liquid stream, and to monitor liquid pressure as analogous to nozzle/surface spacing. Such a procedure cannot work on nonflat surfaces. Furthermore like the air-nozzle system, such an arrangement exerts a perceptible force against the workpiece which can displace it unless it is solidly clamped.

OBJECTS OF THE INVENTION

It is therefore an object of the present invention to provide an improved system for finish grinding.

Another object is the provision of such an improved system for finish grinding which overcomes the above-given disadvantages, that is which allows measurements to be taken that are not effected by minor irregularities in the workpiece, that do not themselves generate forces that shift or deform the workpiece, and that are highly accurate.

SUMMARY OF THE INVENTION

An annular workpiece having an inner peripheral surface and an outer peripheral surface at least one of which is centered on a workpiece axis is ground according to this invention by supporting the workpiece hydraulically on a liquid layer in a support for rotation about the axis, rotating the workpiece about the axis, and engaging a grinding tool radially against the one surface and thereby removing material from the one surface. A plurality of measuring shoes are supported at angularly equispaced locations about the axis and are urged radially toward the one surface. A jet of liquid is projected from each of the shoes against the one surface such that the liquid forms a layer supporting the shoes on the one surface and may merge with the liquid supporting the workpiece.

Thus with this system the shoes do not themselves actually touch the workpiece so that there is no chance of them marring its surface. In addition the angular equispacing of the shoes prevents them from radially shifting the workpiece on its hydraulic cushion or of deforming it. Thus the measurement of the radial spacing of the one surface being ground from the axis can be measured accurately without affecting the workpiece at all. The liquid does not exit from the shoes as a free stream, but instead forms at the face of each shoe into a layer that holds the shoe off the surface being machined.

According to this invention the radial positions of the shoes are monitored relative to the axis and the removal of material from the one surface by the grinding tool is controlled, either by varying grinding force or stopping grinding altogether, in accordance with the monitored radial positions. Two diametrally opposed shoes can be used, or three shoes offset by 120° from each other, or even more can be used.

The liquid projected from the shoes in accordance with this invention is a cutting oil that is wholly compatible with the grinding operation and with the hydraulic supporting function. This liquid can be cooled to prevent overheating of the workpiece and according to the invention the same liquid is supplied to the support and to the shoes from a common source and at generally the same pressure.

In accordance with further features of this invention each of the shoes is formed with a nozzle open radially toward the one surface and each shoe has a face juxtaposed with the one surface and of the same radius of curvature as the one surface. The nozzles are all of the same flow cross section and the liquid is supplied to them at substantially the same pressure.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
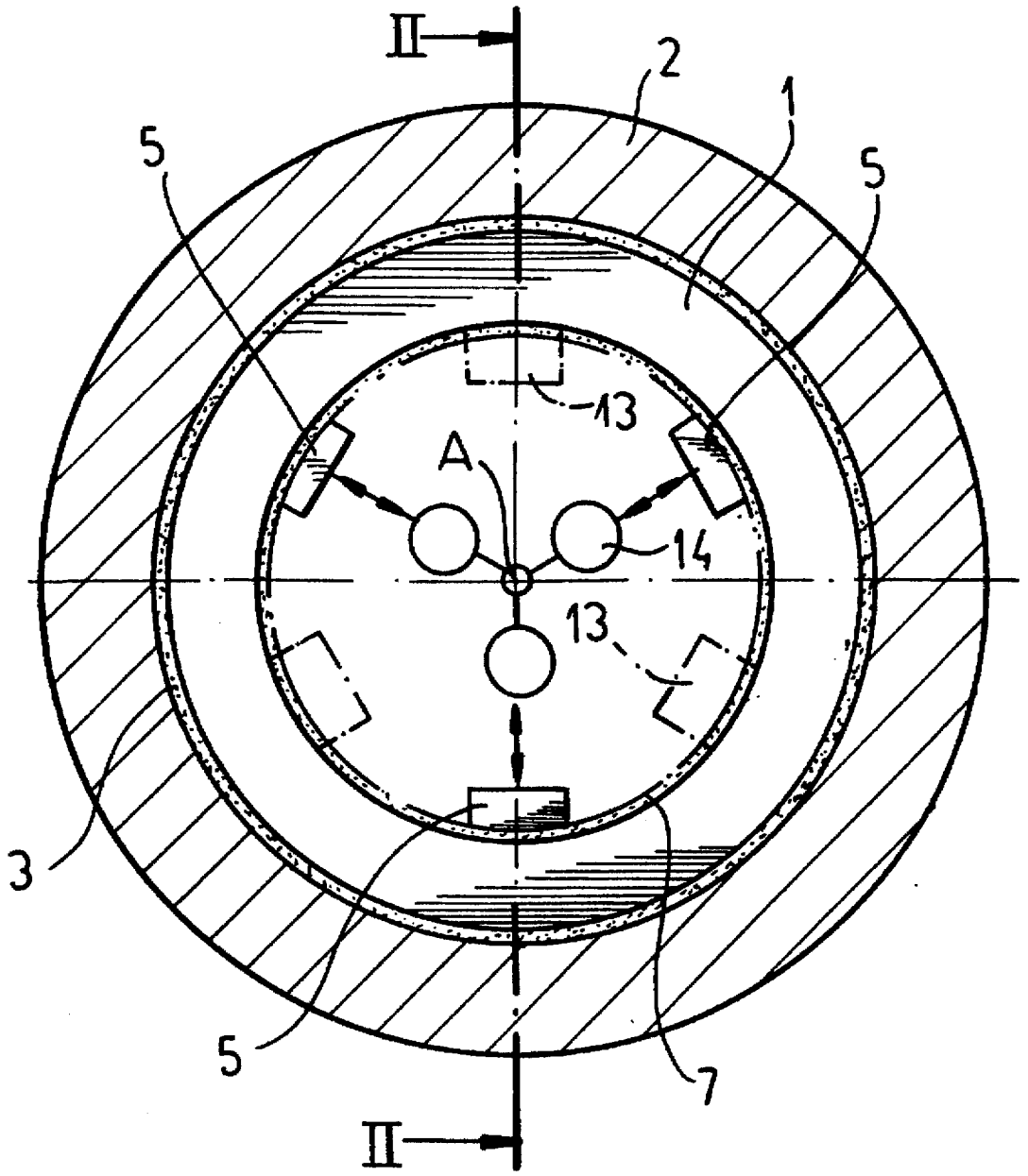
FIG. 1 is a partly diagrammatic cross section through the apparatus for carrying out the method of this invention.
Figure 2:
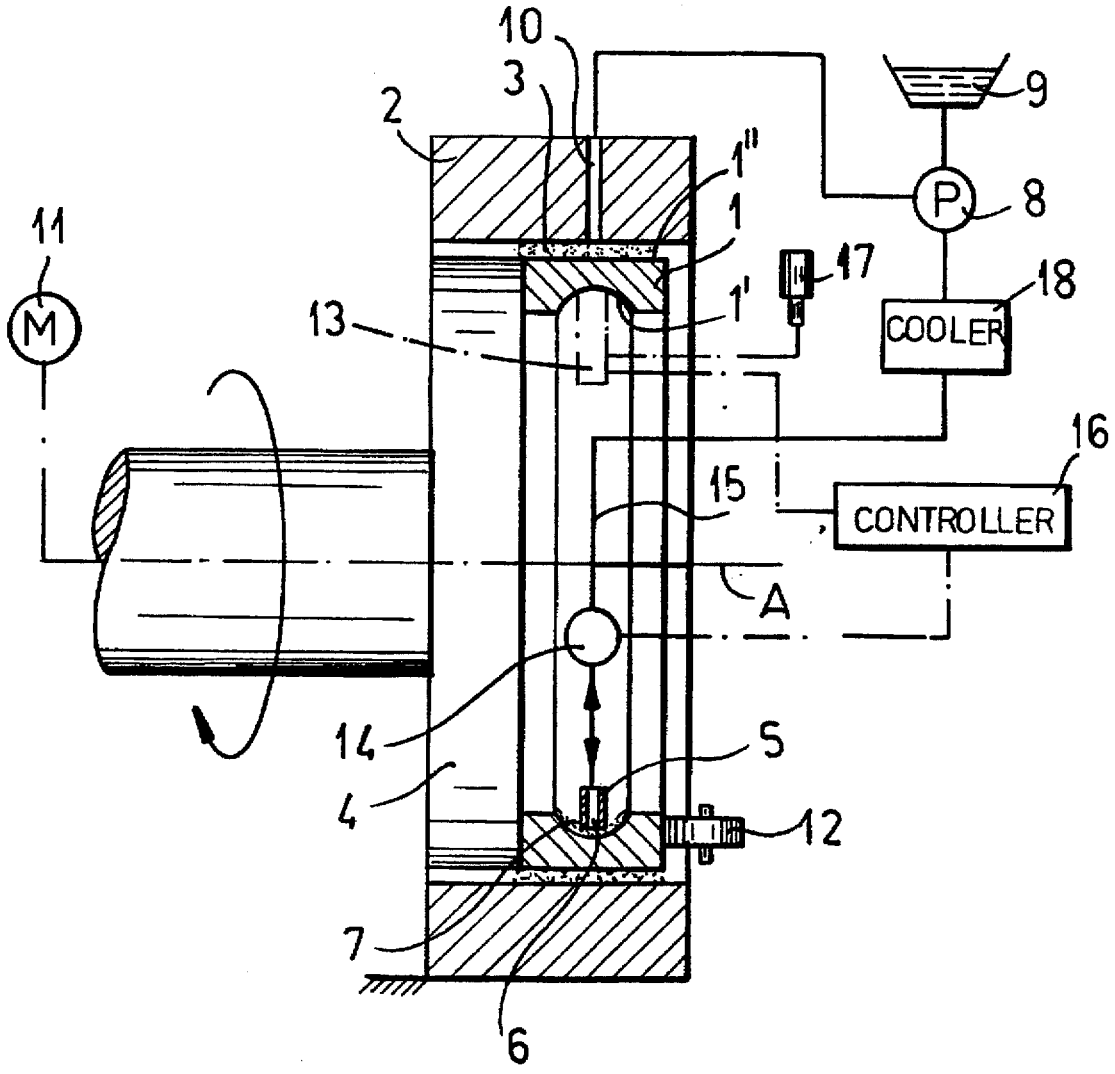
FIG. 2 is a partly diagrammatic axial section taken along line II—II of FIG. 1.

As seen in FIGS. 1 and 2 an annular workpiece 1 having an inner periphery 1' and an outer periphery 1" is suspended in a support ring 2 for rotation about an axis A on a liquid layer 3. This layer 3 is supplied by a pump 8 from a supply 9 and is fed through a passage 10 to the inside-surface of the support ring 2. The workpiece 1 can therefore rotate in the support ring 2 about the horizontal axis A thereof. A disk 4 rotated about the axis A by a motor 11 engages one face of the workpiece 1 and a wheel such as shown at 12 presses the other face of this workpiece 1 to rotationally couple the workpiece 1 to the wheel 4 for rotation of it about the axis A inside the stationary and nonrotating support ring 2. As described in the above-mentioned German patent document, tools such as shown at dot-dash lines at 13 are pressed radially against the inner periphery 1' to machine it. The workpiece 1 here is a ball-bearing race.

According to the invention three angularly equispaced feeler shoes 5 having outer faces complementary to the inner periphery 1' are urged radially outwardly against the inner periphery by actuators shown schematically at 14. These shoes 5 are fixed angularly in the ring 2, that is they do not rotate with the ring 1, and they are each formed with a radially outwardly open nozzle hole 6. The pump 8 is connected via conduits 15 to these nozzle holes 6 to supply same with the liquid from the supply 9, here a cutting oil, so as to form on the inner periphery 1' at the feet 5 a film 7, here shown in exaggerated scale for clarity of view. Thus each of the feeler feet 5 does not actually touch the ring 1, but rides on it on a film of liquid several microns thick.

In accordance with the invention the actuators 14 incorporate position detectors connected to a controller 16 that is connected to the drive motor 11 and/or to actuators 17 for the tools 13. Thus the grinding operation can be stopped when the monitored region, here a groove race, of the inner periphery 1' has the desired diameter. The detected positions of all the shoes 5 can be combined to get an overall reading, or they can be individually weighted against a common set point.

FIG. 2 also shows how a cooler 18 can be provided to cool the liquid fed to the shoes 5. Thus this liquid can be used also to dissipate the heat generated by machining.

Figure 3:
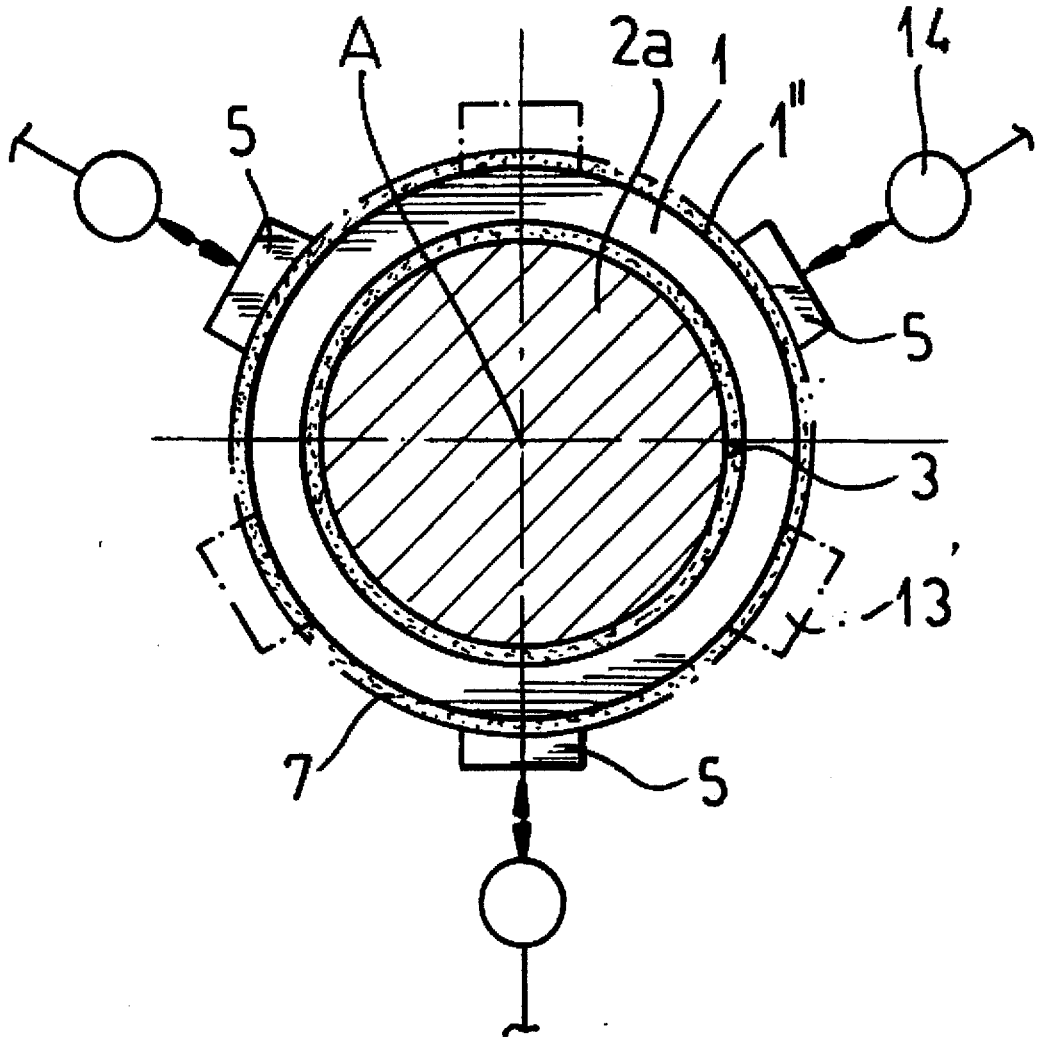
FIG. 3 a small-scale view like FIG. 1 illustrating a variant of the system of this invention.

FIG. 3 shows an arrangement wherein references identical to those of FIG. 1 are used, but where the tools 13 and shoes 5 ride on the outside periphery 1" of the workpiece 1 and a support 2*a* is provided that engages within the workpiece 1'.

I claim:

1. A method of grinding an annular workpiece having an inner peripheral surface and an outer peripheral surface at least one of which is centered on a workpiece axis, the method comprising the steps of:

supporting the workpiece hydraulically on a liquid layer in a support for rotation about the axis;

rotating the workpiece about the axis;

engaging a grinding tool radially against the one surface while constraining the tool against angular movement with the workpiece and thereby removing material from the one surface;

supporting a plurality of measuring shoes at angularly equispaced locations about the axis while constraining the shoes against angular movement with the workpiece and urging the shoes radially toward the one surface; and projecting from each of the shoes against the one surface a jet of liquid such that the liquid forms a layer supporting the shoes on the one surface.

2. The method defined in claim 1, further comprising the steps of:

monitoring the radial positions of the shoes relative to the axis; and controlling the removal of material from the one surface by the grinding tool in accordance with the monitored radial positions.

3. The method defined in claim 1 wherein the liquid projected from the shoes is a cutting oil.

4. The method defined in claim 1, further comprising the step of cooling the liquid projected from the shoes.

5. The method defined in claim 1, further comprising the step of supplying the liquids to the support and to the shoes from a common source and at generally the same pressure.

6. An apparatus for grinding an annular workpiece having an inner peripheral surface and an outer peripheral surface at least one of which is centered on a workpiece axis, the apparatus comprising:

means including a support for supporting the workpiece hydraulically on a liquid layer for rotation about the axis;

drive means for rotating the workpiece about the axis;

a grinding tool engageable radially against the one surface and constrained against angular movement with the work piece, whereby the tool can remove material from the one surface;

a plurality of measuring shoes;

means for supporting the shoes at angularly equispaced locations about the axis while constraining the shoes against angular movement with the workpiece and for urging the shoes radially toward the one surface, each of the shoes being formed with a nozzle open radially toward the one surface; and pump means connected to the nozzles for projecting from each of the nozzles against the one surface a jet of liquid such that the liquid forms a layer supporting the shoes on the one surface.

7. The apparatus defined in claim 6 wherein each shoe has a face juxtaposed with the one surface and of the same radius of curvature as the one surface.

8. The apparatus defined in claim 6 wherein all the nozzles are of the same flow cross section, the pump means being connected identically to all the nozzles to supply the nozzles with the liquid at the same pressure.

9. The apparatus defined in claim 6, further comprising means for detecting the radial positions of the shoes relative to the axis and for generating an output corresponding to the detected position;

control means connected between the connecting means and the grinding tool for controlling grinding in accordance with the detected position.

* * * * *